US006815998B1

(12) United States Patent
Samad

(10) Patent No.: US 6,815,998 B1
(45) Date of Patent: Nov. 9, 2004

(54) ADJUSTABLE-RATIO GLOBAL READ-BACK VOLTAGE GENERATOR

(75) Inventor: Maheen A. Samad, Sunnyvale, CA (US)

(73) Assignee: Xilinx, Inc., San Jose, CA (US)

( * ) Notice: Subject to any disclaimer, the term of this patent is extended or adjusted under 35 U.S.C. 154(b) by 0 days.

(21) Appl. No.: 10/278,302

(22) Filed: Oct. 22, 2002

(51) Int. Cl.[7] ..... G05F 3/02
(52) U.S. Cl. ..... 327/530; 327/334; 327/536
(58) Field of Search ..... 327/143, 334, 327/530, 543, 546

(56) References Cited

U.S. PATENT DOCUMENTS 4,750,155 A 6/1988 Hsieh
5,856,756 A * 1/1999 Sasahara et al. ..... 327/540
5,892,394 A * 4/1999 Wu ..... 327/546
6,002,295 A * 12/1999 Gens et al. ..... 327/546
6,091,287 A * 7/2000 Salter et al. ..... 327/543
6,359,992 B1 * 3/2002 Preves et al. ..... 381/312
6,492,864 B2 * 12/2002 Mahrla ..... 327/540
2002/0097627 A1 * 7/2002 Sacco et al. ..... 365/226
2002/0140495 A1 * 10/2002 Wicke et al. ..... 327/530

* cited by examiner

*Primary Examiner*—Terry D. Cunningham
(74) *Attorney, Agent, or Firm*—E. Eric Hoffman; Edel M. Young; Lois D. Cartier

(57) ABSTRACT

A voltage generation circuit for generating a read-back voltage in response to a supply voltage and a reference voltage. The voltage generation circuit includes a comparator configured to receive the supply voltage and the reference voltage. The voltage generation circuit activates a select signal if the supply voltage has a predetermined relationship with respect to the reference voltage, and de-activates the select signal if the supply voltage does not exhibit the predetermined relationship with respect to the reference voltage. An adjustable voltage divider circuit is coupled to receive the supply voltage and the select signal. The adjustable voltage divider circuit is configured in response to the select signal to provide an output voltage that is a first percentage of the supply voltage if the select signal is activated, and provide an output voltage that is a second percentage of the supply voltage if the select signal is de-activated.

22 Claims, 9 Drawing Sheets

ADJUSTABLE-RATIO GLOBAL READ-BACK VOLTAGE GENERATOR

FIELD OF THE INVENTION

The present invention relates to a circuit used to regulate the read-back voltage applied to address lines of a memory circuit during a read-back operation. More specifically, the present invention relates to a circuit that provides a read-back voltage as an adjustable percentage of a core supply voltage, with the ability to select the specific percentage depending on the actual level of the core supply voltage.

BACKGROUND OF THE INVENTION

Programmable logic devices, such as field programmable gate arrays (FPGAs), include configuration memory cells that are loaded with configuration data values. These configuration data values control the configuration of the programmable logic device. FPGAs often include a read-back mechanism that enables the previously written configuration data values to be read from the configuration memory cells.

FIG. 1 shows a conventional array of configuration memory cells (i.e., a configuration memory) such as used by Xilinx, Inc., assignee of the present invention. The configuration memory of FIG. 1 is a 16-bit by 16-bit array, which includes 256 configuration memory cells. In general, each of the configuration memory cells is identified by a reference character $M_{X,Y}$, where X and Y correspond with the row and column of the configuration memory cell. A typical array of configuration memory cells in a commercial device has on the order of 20,000 to one million memory cells. Thus the array of FIG. 1 is much smaller than is typically used in a commercial embodiment, but nevertheless shows the structure of prior art configuration memories. To load the configuration memory, a bit stream of configuration data values (DATA) is shifted into data control circuit DC, under control of a clocking mechanism, until a frame of data (16 bits wide in this example) has been shifted into bit positions C0 through C15 of data control circuit DC. This frame of data is then routed from bit positions C0–C15 to data lines $D_0$–$D_{15}$, respectively. Note that only data lines $D_0$ and $D_{15}$ are labeled for purposes of clarity.

Address control circuit AC, which includes address drivers 0–15, drives a write enable signal onto one of the address lines $A_0$–$A_{15}$, thereby enabling the configuration data values on lines $D_0$–$D_{15}$ to be written to a column of the configuration memory cells. Note that only address lines $A_0$ and $A_{15}$ are labeled for purposes of clarity.

Hsieh in U.S. Pat. No. 4,750,155 describes a five transistor memory cell that can be reliably read and written by applying a lower read-back voltage to a memory cell access transistor than is applied to the memory cell access transistor to write a new value. The Hsieh patent is incorporated herein by reference.

FIG. 2 is a circuit of a conventional six-transistor configuration memory cell $M_{0,0}$ that includes an n-channel access transistor $T_1$, an n-channel reset transistor $T_2$ and two CMOS inverters $I_1$ and $I_2$. As is well known in the CMOS design art, each of the two inverters $I_1$ and $I_2$ comprise one PMOS transistor and one NMOS transistor connected in series between the $V_{DD}$ supply voltage and ground. Inverters $I_1$ and $I_2$ are cross-coupled, thereby forming a latch. This latch is connected to data line $D_0$ by access transistor $T_1$, which is controlled by a control voltage on address line $A_0$. One or more lines Q and/or Q# extends from configuration memory cell $M_{0,0}$ to the FPGA logic structure (not shown) to control the configuration of this structure.

Configuration memory cell $M_{0,0}$ is initially reset by turning on the n-channel reset transistor $T_2$. This reset mechanism enables the transistors in inverters $I_1$ and $I_2$ to be made relatively small (because configuration memory cell $M_{0,0}$ does not have to be reset via data line $D_0$) While it is desirable to have relatively small transistors to reduce layout area, these small transistors undesirably result in relatively weak inverters $I_1$ and $I_2$. Thus, the configuration memory value stored by inverters $I_1$ and $I_2$ is more susceptible to being disturbed during a read back operation where the charge on a large data line can flip the value stored by the small memory cell.

To write a configuration data value to the first column of configuration memory cells $M_{0,0}$–$M_{15,0}$, address driver 0 is controlled to drive a write enable voltage equal to the $V_{DD}$ supply voltage to address line $A_0$. This relatively high write voltage assures that the access transistors (e.g., access transistor $T_1$) are completely turned on during the write operation, such that the configuration data values are properly written to the configuration memory cells.

The configuration data values stored in configuration memory cells $M_{0,0}$–$M_{15\text{-}15}$ can subsequently be read back to data control circuit DC on a column-by-column basis. For example, to read the configuration data values stored in the first column of configuration memory cells $M_{0,0}$–$M_{15,0}$, address control circuit AC causes address driver 0 to apply a read-back voltage to address line $A_0$. This read-back voltage is typically selected to be equal to the $V_{DD}$ supply voltage minus the threshold voltage ($V_T$) of access transistor $T_1$. Under these conditions, the configuration data values stored in configuration memory cells $M_{0,0}$ to $M_{15,0}$ are read back to the data control circuit DC on data lines $D_0$–$D_{15}$. The read-back voltage is low enough to ensure that the read-back operation does not disturb the configuration data values stored in the configuration memory cells $M_{0,0}$–$M_{15,0}$. Note that the read-back voltage is referenced to the $V_{DD}$ supply voltage because the associated circuitry in data control circuit DC operates in response to the $V_{DD}$ supply voltage.

During normal operation, the $V_{DD}$ supply voltage can typically vary +/−10 percent with respect to a nominal supply voltage value. Thus, a $V_{DD}$ supply voltage having a nominal value of 1.2 Volts can vary from 1.08 to 1.32 Volts. For relatively low $V_{DD}$ supply voltages, the read-back voltage ($V_{DD}$−$V_T$) might be too low to reliably read the configuration memory cell. For example, a $V_{DD}$ supply voltage of 1.08 Volts would produce a read-back voltage of about 0.710 Volts, assuming a threshold voltage of 0.370 Volts. This read-back voltage may be inadequate to reliably read the configuration data values stored in the configuration memory cells.

It would therefore be desirable to have a method and apparatus for generating acceptable read-back voltages for a memory circuit, such as a configuration memory array of a programmable logic device, for all possible values of the $V_{DD}$ supply voltage.

SUMMARY

Accordingly, the present invention provides a read-back voltage generation circuit that provides a read-back voltage as an adjustable percentage of a supply voltage. The read-back voltage generation circuit has the ability to select the specific percentage depending on the actual level of the supply voltage. For example, if the supply voltage has a relatively high value, then the read-back voltage will be a relatively low percentage of the supply voltage. Conversely, if the supply voltage has a relatively low value, then the read-back voltage will be a relatively high percentage of the supply voltage. As a result, the read-back voltage will always be high enough to reliably read the configuration data values from the configuration memory cells within a given time margin, but not so high as to overwrite these configuration data values. The read-back voltage generation circuit is especially advantageous for use in a chip having a low core supply voltage, wherein a threshold voltage drop ($V_T$) represents a large percentage of the core supply voltage.

In one embodiment, the read-back voltage generation circuit buffers the read-back voltage through a low output impedance buffer that is capable of supplying the proper voltage for the address lines on the chip. The read-back voltage generation circuit is designed to use minimal DC current, but is still able to charge the address lines quickly and efficiently to a value that properly controls the read-back function.

In accordance with one embodiment, the read-back voltage generation circuit includes a comparator configured to receive the supply voltage and a reference voltage. The voltage generation circuit activates a select signal if the supply voltage has a predetermined relationship with respect to the reference voltage, and de-activates the select signal if the supply voltage does not exhibit the predetermined relationship with respect to the reference voltage. For example, the comparator can activate the select signal if the supply voltage is less than the reference voltage, and de-activate the select signal if the supply voltage is greater than the reference voltage.

An adjustable voltage divider circuit is coupled to receive the supply voltage and the select signal. The adjustable voltage divider circuit is configured in response to the select signal to provide an output voltage that is a first percentage of the supply voltage if the select signal is activated, and provide an output voltage that is a second percentage of the supply voltage if the select signal is de-activated. For example, the adjustable voltage divider circuit can be configured to provide an output voltage that is 95–100 percent of the supply voltage if the select signal is activated, and provide an output voltage that is less than 95 percent of the supply voltage if the select signal is de-activated. A low impedance, current limited output driver drives the output voltage as the read-back voltage.

In one embodiment, the reference voltage is derived from a bandgap voltage generator, thereby providing a relatively constant reference voltage.

One variation of the present invention uses multiple comparators to compare the supply voltage to a plurality of reference voltages. Such a variation enables finer control over the read-back voltage level.

The present invention will be more fully understood in view of the following description and drawings.

DETAILED DESCRIPTION

Figure 3:
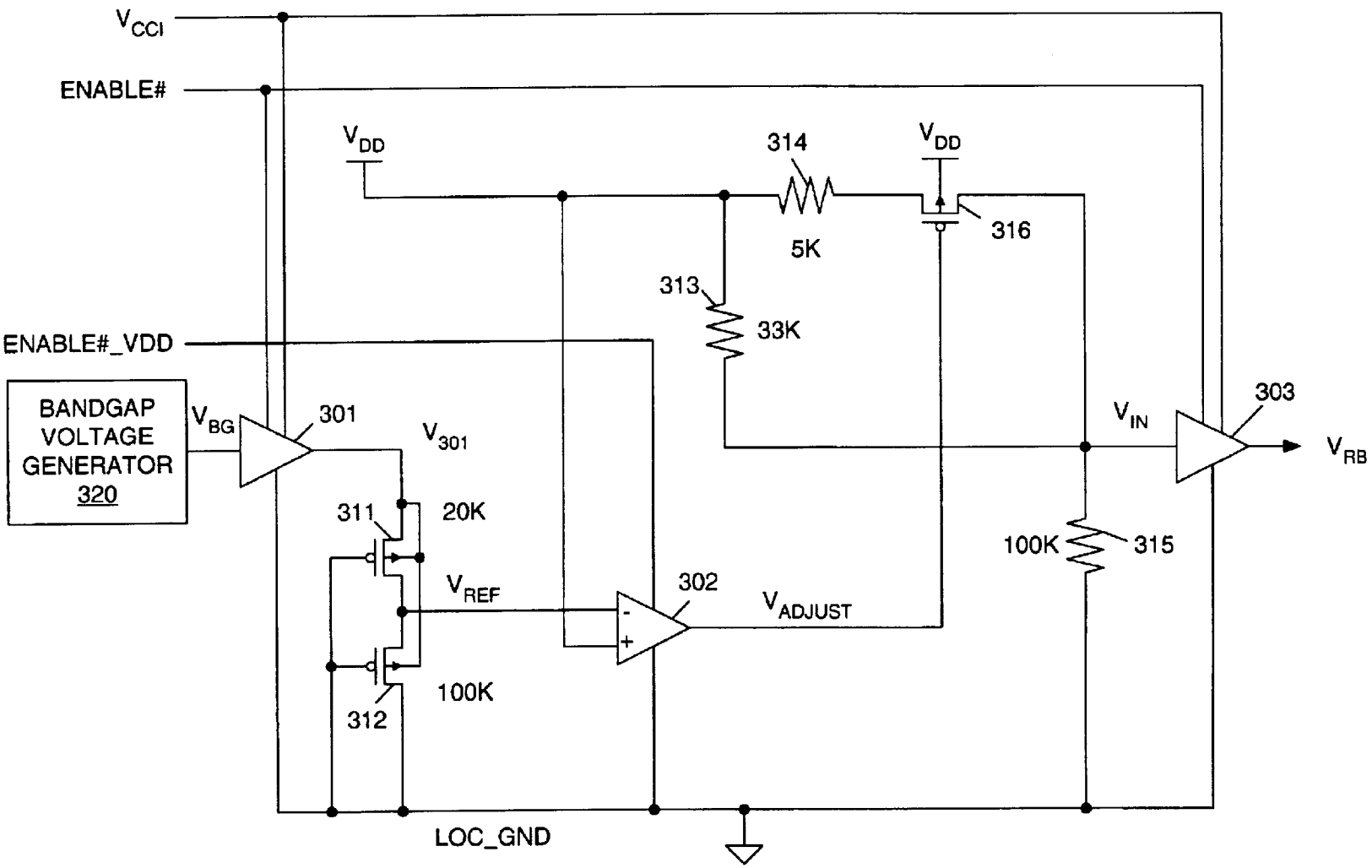
FIG. 3 is a circuit diagram of a read-back voltage generation circuit in accordance with one embodiment of the present invention.

FIG. 3 is a circuit diagram of a read-back voltage generation circuit 300 in accordance with one embodiment of the present invention. Read-back voltage generation circuit 300 includes band-gap reference buffer 301, comparator 302, output driver 303, p-channel transistors 311–312, resistors 313–315, p-channel pass transistor 316 and bandgap voltage generator 320.

Figure 1:
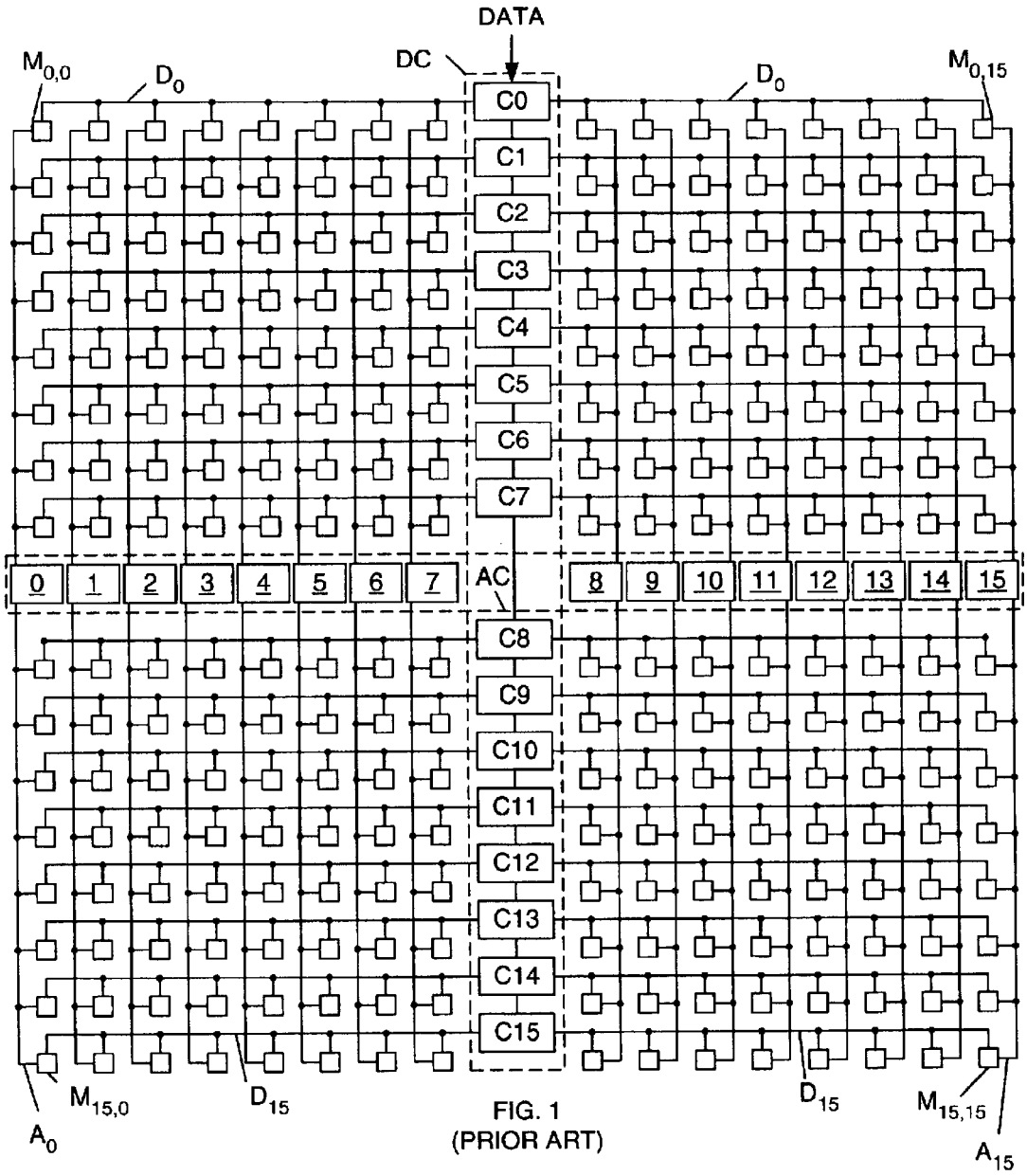
FIG. 1 (PRIOR ART)
FIG. 1 is a block diagram of a conventional array of configuration memory cells, a data control circuit, and an address control circuit.
Figure 2:
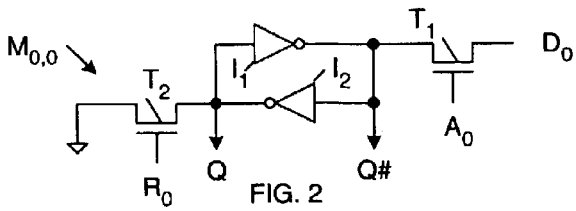
FIG. 2 (PRIOR ART)
FIG. 2 is a circuit diagram of a conventional configuration memory cell.

In accordance with the described embodiment, read-back voltage generation circuit 300 generates a read-back voltage $V_{RB}$, which is used to access configuration memory cells of a programmable logic device, such as a field programmable gate array, during a read-back operation. For example, the read-back voltage $V_{RB}$ generated by circuit 300 can be selectively applied to the address lines $A_0$–$A_{15}$ of the configuration memory array of FIG. 1 during a read-back operation. Alternately, read-back voltage generation circuit 300 can be used to generate a read-back voltage for a general memory circuit, or generate any sensitive referenced voltage for a voltage-level sensitive circuit.

As described in more detail below, the level of the read-back voltage $V_{RB}$ is determined in response to the actual level of the $V_{DD}$ supply voltage. Thus, if the $V_{DD}$ supply voltage is greater than a predetermined voltage, then circuit 300 will generate a read-back voltage that is a first percentage of the $V_{DD}$ supply voltage. If the $V_{DD}$ supply voltage is less than or equal to the predetermined voltage, then circuit 300 will generate a read-back voltage that is a second percentage of the $V_{DD}$ supply voltage. In accordance with one embodiment of the present invention, the first percentage is less than the second percentage. For example, of the $V_{DD}$ supply voltage is greater than the predetermined voltage, the read-back voltage $V_{RB}$ may have a voltage that is 75% of the $V_{DD}$ supply voltage. Conversely, if the $V_{DD}$ supply voltage is less than or equal to a predetermined voltage, the read-back voltage $V_{RB}$ may have a voltage that is 95% of the $V_{DD}$ supply voltage. This ensures that the read-back voltage will be high enough to reliably access the configuration memory cells within a predetermined time margin during a read-back operation, without overwriting the configuration data values stored in the configuration memory cells. Note that a read-back voltage $V_{RB}$ that is too high and rises too fast can disturb memory in the associated memory cell. Also note that the read-back voltage $V_{RB}$ is referenced to the $V_{DD}$ supply voltage because the circuitry implementing the read-back function operates in response to the $V_{DD}$ supply voltage.

Read-back voltage generation circuit 300 generates a read-back voltage $V_{RB}$ in response to a core supply voltage $V_{DD}$, an auxiliary supply voltage $V_{CCI}$, a first active-low enable signal ENABLE#, a second active-low enable signal ENABLE#_$V_{DD}$, a bandgap reference voltage $V_{BG}$ and a ground supply voltage LOC_GND.

Band-gap buffer 301 is configured to receive the bandgap reference voltage $V_{BG}$ from bandgap voltage generator 320, the core supply voltage $V_{CCI}$, the enable signal ENABLE#, and the local ground supply voltage LOC_GND. In response to these signals, band-gap butter 301 provides an output voltage $V_{301}$, which is relatively constant with respect to voltage and temperature variations.

Figure 4:
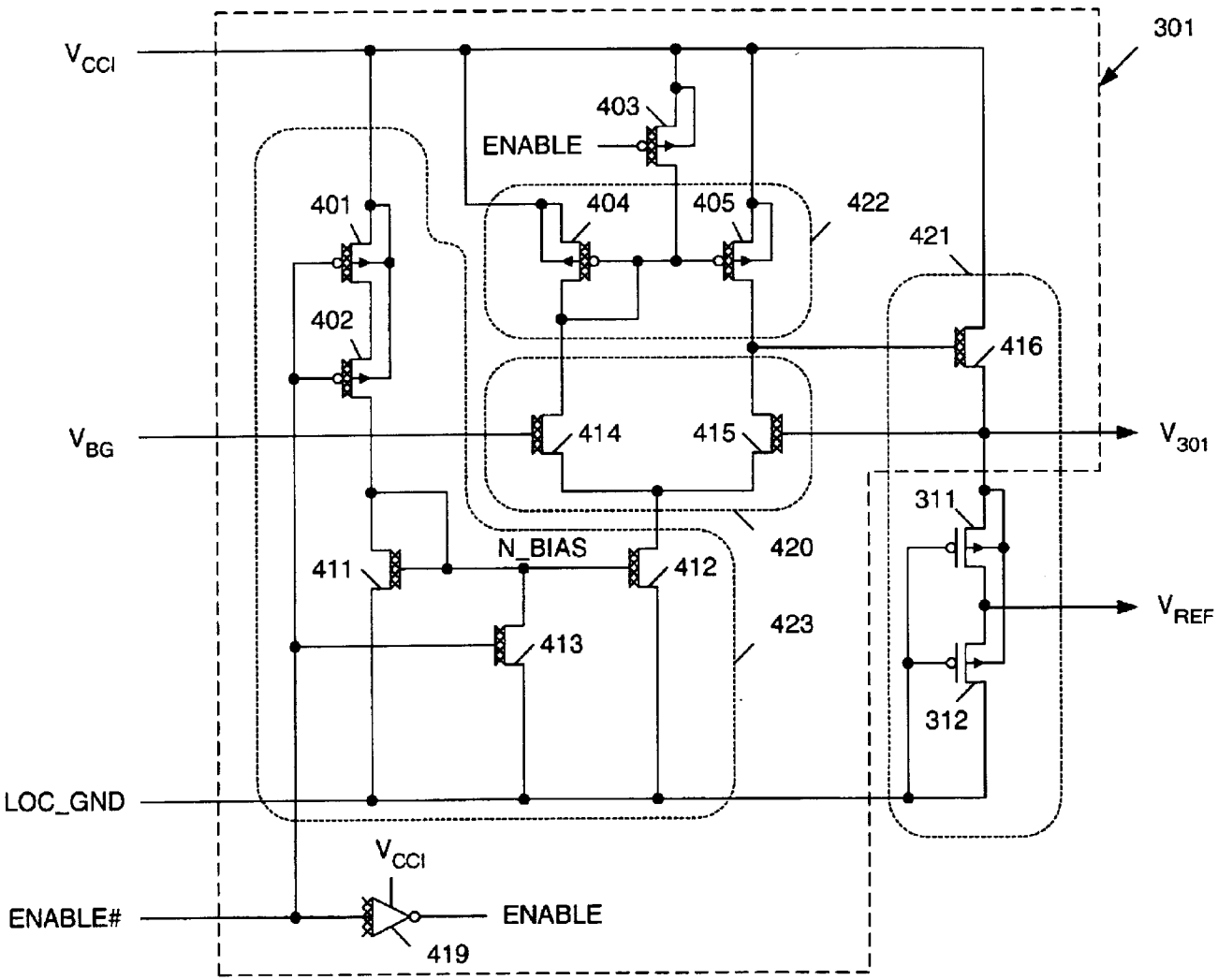
FIG. 4 is a circuit diagram of a band-gap buffer used in the read-back voltage generation circuit of FIG. 3 in accordance with one embodiment of the present invention.

FIG. 4 is a circuit diagram of band-gap buffer 301 and p-channel transistors 311–312 in accordance with one embodiment of the present invention. Band-gap buffer 301 includes thick-oxide p-channel transistors 401–405, thick-oxide n-channel transistors 411–416 and thick-oxide inverter 419. Thick-oxide elements are used in band-gap buffer 301, because these elements operate in response to the $V_{CCI}$ supply voltage, which is higher than the $V_{DD}$ supply voltage. In the described example, the $V_{CCI}$ supply voltage has a nominal value of 2.5 Volts, while the $V_{DD}$ supply voltage has a nominal value of 1.2 Volts. The $V_{CCI}$ supply voltage is used to operate all circuitry of the FPGA that requires a higher voltage than the $V_{DD}$ supply voltage, but cannot tolerate the noise associated with the input/output supply voltage $V_{CCO}$, while the $V_{DD}$ supply voltage is used to operate the core logic of the FPGA.

N-channel transistors 414 and 415 form a differential pair 420. The gate of n-channel transistor 414 is coupled to receive the bandgap voltage $V_{BG}$, which is a relatively constant voltage. In the described example, the bandgap voltage $V_{BG}$ has a value of about 1.196 Volts, with negligible variations in response to variations in temperature, process or supply voltage. The bandgap voltage $V_{BG}$ is provided by a conventional bandgap voltage generator 320. The gate of n-channel transistor 415 is coupled to an output stage 421, which includes n-channel transistor 416 and p-channel transistors 311–312 (FIG. 3). N-channel transistor 416 is coupled between the gate of transistor 415 and the $V_{CCI}$ voltage supply terminal. P-channel transistors 311–312 are coupled in series between the gate of transistor 415 and the ground supply terminal LOC_GND.

The differential pair 420 is supplied by a current mirror circuit 422 formed by p-channel transistors 404–405, and n-channel bias transistor 412. P-channel transistor 404 is coupled between the drain of n-channel transistor 414 and the $V_{CCI}$ supply voltage terminal, and p-channel transistor 405 is coupled between the drain of n-channel transistor 415 and the $V_{CCI}$ voltage supply terminal. The gates of p-channel transistors 404 and 405 are commonly coupled to the drain of n-channel transistor 414.

Current mirror circuit 422 is enabled and disabled by p-channel transistor 403, which is coupled between the $V_{CCI}$ voltage supply terminal and the gates of p-channel transistors 404 and 405. P-channel transistor 403 is controlled by an ENABLE signal provided by inverter 419. When the enable signal ENABLE# is activated low, the read-back voltage generation circuit 300 is enabled, thereby causing the ENABLE signal to go high. The high ENABLE signal turns off p-channel transistor 403, thereby enabling current mirror circuit 422.

The low ENABLE# signal also activates a bias control circuit 423, which includes p-channel transistors 401–402 and n-channel transistors 411–413. The logic low ENABLE# signal turns on p-channel transistors 401–402 and turns off n-channel transistor 413. As a result, a logic high bias voltage N_BIAS is developed on the gate of n-channel transistor 412, thereby causing a bias current to flow through this transistor 412, as well as differential pair 420.

Once enabled, band-gap buffer 301 operates as follows. The enabled bias circuit 423 ensures that a constant current flows through bias transistor 412 (and thereby through differential pair 420). The enabled current mirror circuit 422 operates to maintain equal currents through differential pair transistors 414 and 415. The constant bandgap voltage $V_{BG}$ causes a first current to flow through transistor 414 of differential pair 420. Current mirror 422 attempts to mirror this current to transistor 415 of differential pair 420. The voltage on the drain of transistor 415 biases the gate of transistor 416 of output stage 421. In response, transistor 416 biases the voltage $V_{301}$ on the gate of transistor 415 to a voltage equal to the bandgap voltage $V_{BG}$ to bring differential pair 420 into equilibrium, wherein the gates of transistors 414 and 415 have the same voltage. This happens because of the feedback loop configuration of differential amplifier 420.

The voltage $V_{301}$ is applied to p-channel transistors 311 and 312. P-channel transistors 311 and 312 form a voltage divider circuit, wherein the node connecting these p-channel transistors 311–312 provides a reference voltage $V_{REF}$. P-channel transistors 311 and 312 are sized to have on-resistances that provide the desired voltage division ratio. In the described embodiment, p-channel transistors 311 and 312 are designed to have resistances exhibiting a ratio of about 20:100. As a result, the reference voltage $V_{REF}$ has a value equal to $V_{301}\times 100/120$ or about 0.997 Volts. In an alternative embodiment, p-channel transistors 311–312 can be replaced with resistors that exhibit the desired-ratio.

Because the reference voltage $V_{REF}$ is derived from the constant bandgap voltage $V_{BG}$, the reference voltage $V_{REF}$ is also a constant voltage. As will become apparent in view of the following description, the reference voltage $V_{REF}$ is selected to correspond with the $V_{DD}$ voltage level at which the read-back voltage $V_{RB}$ is adjusted. The reference voltage $V_{REF}$ is applied to the minus input terminal of comparator 302 (FIG. 3), and the $V_{DD}$ supply voltage is applied to the plus input terminal of comparator 302. In general, comparator 302 provides a logic high output voltage $V_{ADJUST}$ if the $V_{DD}$ supply voltage is greater than the reference voltage $V_{REF}$. Conversely, comparator 302 provides a logic low output voltage $V_{ADJUST}$ if the $V_{DD}$ supply voltage is less than the reference voltage $V_{REF}$.

Figure 5:
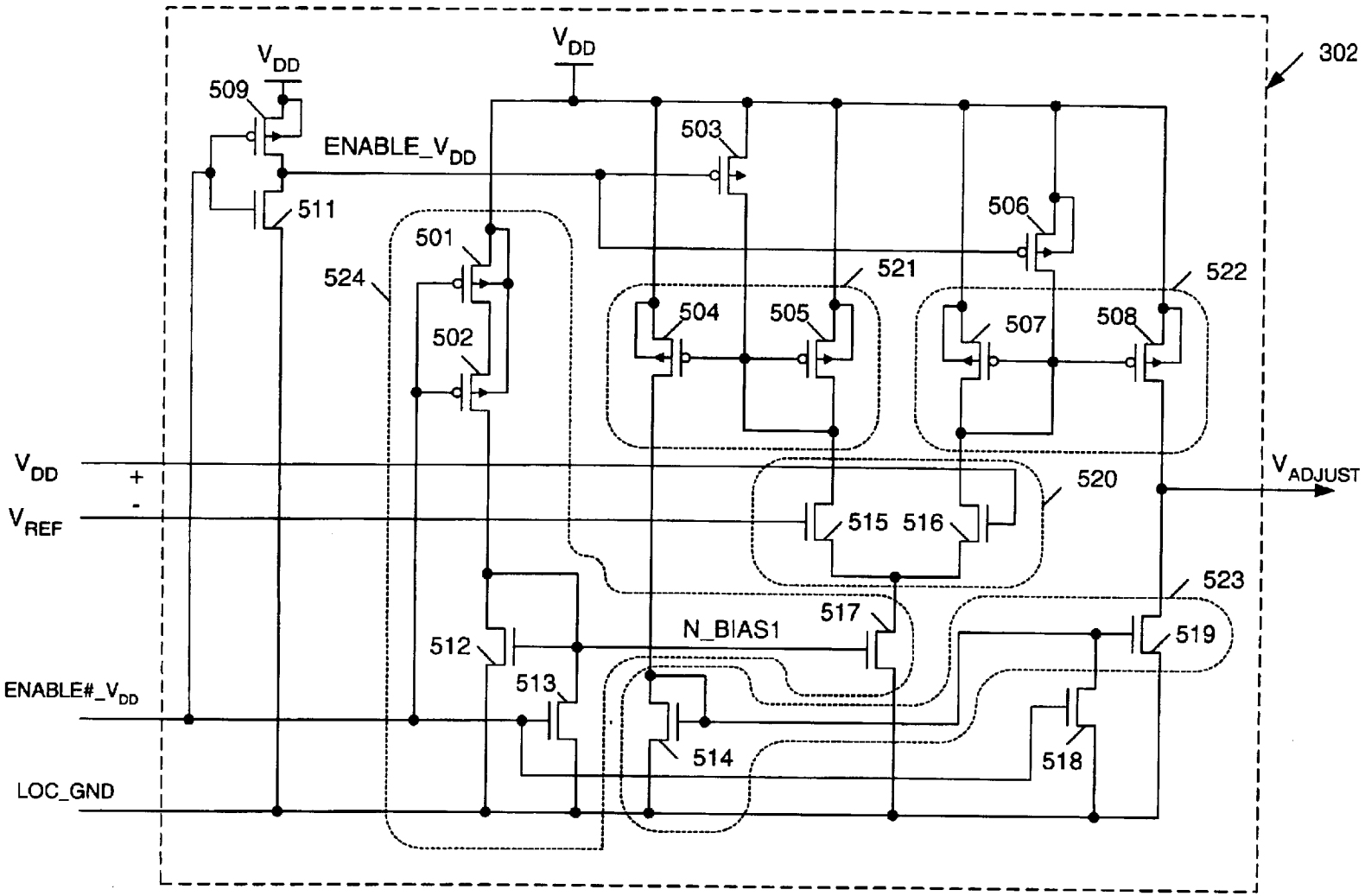
FIG. 5 is a circuit diagram illustrating a comparator used in the read-back voltage generation circuit of FIG. 3 in accordance with one embodiment of the present invention.

FIG. 5 is a circuit diagram illustrating comparator 302 in accordance with one embodiment of the present invention. Comparator 302 includes p-channel transistors 501–509 and n-channel transistors 511–519.

N-channel transistors 515 and 516 form a differential pair 520. The gate of n-channel transistor 515 is coupled to receive the reference voltage $V_{REF}$, and the gate of n-channel transistor 516 is coupled to receive the $V_{DD}$ supply voltage.

The differential pair 520 is supplied by current mirror circuits 521 and 522, and n-channel bias transistor 517. Current mirror circuit 521, which supplies current to transistor 515 of differential pair 520, includes p-channel transistors 504 and 505. Current mirror circuit 522, which supplies current to transistor 516 of differential pair 520, includes p-channel transistors 507 and 508. Current mirror circuits 521 and 522 are coupled to current mirror circuit 523, which is formed by n-channel transistors 514 and 519.

Current mirror circuit 521 is enabled and disabled by p-channel transistor 503, which is coupled between the $V_{DD}$ voltage supply terminal and the gates of p-channel transistors 504 and 505. Similarly, current mirror circuit 522 is enabled and disabled by p-channel transistor 506, which is coupled between the $V_{DD}$ voltage supply terminal and the gates of p-channel transistors 507 and 508. Current mirror circuit 523 is enabled and disabled by n-channel transistor 518, which is coupled between the ground supply voltage terminal LOC_GND, and the gates of n-channel transistors 514 and 519.

N-channel transistor 518 is controlled by the ENABLE#_$V_{DD}$ signal provided to comparator 302. P-channel transistors 503 and 506 are controlled by an ENABLE_$V_{DD}$ signal provided by the inverter formed by transistors 509 and 511. When the read-back voltage generation circuit 300 is enabled, the ENABLE#_$V_{DD}$ signal is activated low, thereby turning off n-channel transistor 518 and activating current mirror circuit 523. The logic low ENABLE#_$V_{DD}$ signal causes the ENABLE_$V_{DD}$ signal to go high, thereby turning off p-channel transistors 503 and 506, and activating current mirror circuits 521 and 522.

The low ENABLE#_$V_{DD}$ signal also activates a bias control circuit 524, which includes p-channel transistors 501–502 and n-channel transistors 512–513 and 517. The logic low ENABLE#_$V_{DD}$ signal turns on p-channel transistors 501–502 and turns off n-channel transistor 513. As a result, a logic high bias voltage N_BIAS1 is developed on the gate of n-channel transistor 517, thereby causing a bias current to flow through this transistor 517, as well as differential pair 520.

Once enabled, comparator 302 operates as follows. The enabled bias circuit 524 ensures that a constant current flows through bias transistor 517 (and thereby through differential pair 520). The $V_{DD}$ supply voltage applied to transistor 516 will typically be greater than or less than the reference voltage $V_{REF}$ applied to transistor 515. For example, assume that the $V_{DD}$ supply voltage is greater than the reference voltage $V_{REF}$. The relatively high voltage applied to transistor 516 will cause the current through this transistor 516 (and through transistor 507) to increase. In response, current mirror circuit 522 causes the current through transistor 508 to similarly increase.

The relatively low voltage applied to transistor 515 will cause the current through this transistor (and through transistor 505) to decrease. In response, current mirror circuit 521 causes the current through transistor 504 to similarly decrease. The current through transistor 514 (being equal to the current through transistor 504) also decreases. In response, current mirror circuit 523 causes the current through transistor 519 to decrease.

Thus, the current through p-channel transistor 508 increases, while the current through n-channel transistor 519 decreases. Under these conditions, the output voltage $V_{ADJUST}$ of comparator 302 is pulled up to the $V_{DD}$ supply voltage.

In a similar manner, if the $V_{DD}$ supply voltage is less than the reference voltage $V_{REP}$, the current through p-channel transistor 508 decreases, while the current through n-channel transistor 519 increases. Under these conditions, the output voltage $V_{ADJUST}$ Of comparator 302 is pulled down to the ground supply voltage LOC_GND. In the foregoing manner, comparator 302 provides a full rail-to-rail comparator with fairly low operating DC current.

The output voltage $V_{ADJUST}$ of comparator 302 is applied to the gate of p-channel pass transistor 316. As described above, if the $V_{DD}$ supply voltage is greater than the reference voltage $V_{REF}$, the output voltage $V_{ADJUST}$ of comparator 302 will be pulled up to the $V_{DD}$ supply voltage, thereby turning off pass transistor 316. Under these conditions, the $V_{DD}$ supply voltage is applied to a voltage divider circuit that includes resistors 313 and 315. In the described embodiment, resistors 313 and 315 are unsalicided P+0 polysilicon resistors having nominal resistances of 33 kOhms and 100 kOhms, respectively. Thus, the voltage $V_{IN}$ will be about 75 percent of the $V_{DD}$ supply voltage. As described in more detail below, output driver 303 drives this voltage $V_{IN}$ as the read-back voltage $V_{RB}$. Thus, when the $V_{DD}$ supply voltage is relatively high, the read-back voltage $V_{RB}$ is selected to have a value equal to about 75 percent of the $V_{DD}$ supply voltage.

Conversely, if the $V_{DD}$ supply voltage is less than the reference voltage $V_{REF}$, the output voltage $V_{ADJUST}$ of comparator 302 will be pulled down to the ground supply voltage LOC_GND in the manner described above, thereby turning on pass transistor 316. Under these conditions, the $V_{DD}$ supply voltage is applied to a voltage divider circuit that includes resistors 313, 314 and 315. In the described embodiment, resistor 314 is an unsalicided P+ polysilicon resistor having a nominal resistances of 5 kOhms. When pass transistor 316 is turned on, a voltage divider circuit is formed, with one leg of the voltage divider circuit consisting of resistors 313 and 314 coupled in parallel (with an equivalent resistance of about 4.3 kOhms), and the other leg of the voltage divider consisting of resistor 315. Thus, the voltage $V_{IN}$ will be about 96 percent of the $V_{DD}$ supply voltage. As described in more detail below, output driver 303 drives this voltage $V_{IN}$ as the read-back voltage $V_{RB}$. Thus, when the $V_{DD}$ supply voltage is relatively high, the read-back voltage $V_{RB}$ is selected to have a value equal to about 96 percent of the $V_{DD}$ supply voltage.

The above-described percentages were selected in view of a simulation that indicated that memory disturb was more prevalent for higher values of $V_{DD}$ supply voltage, and memory read delay time was more of an issue for low values of the $V_{DD}$ supply voltage. Other percentages can be selected in other embodiments of the present invention.

Figure 6:
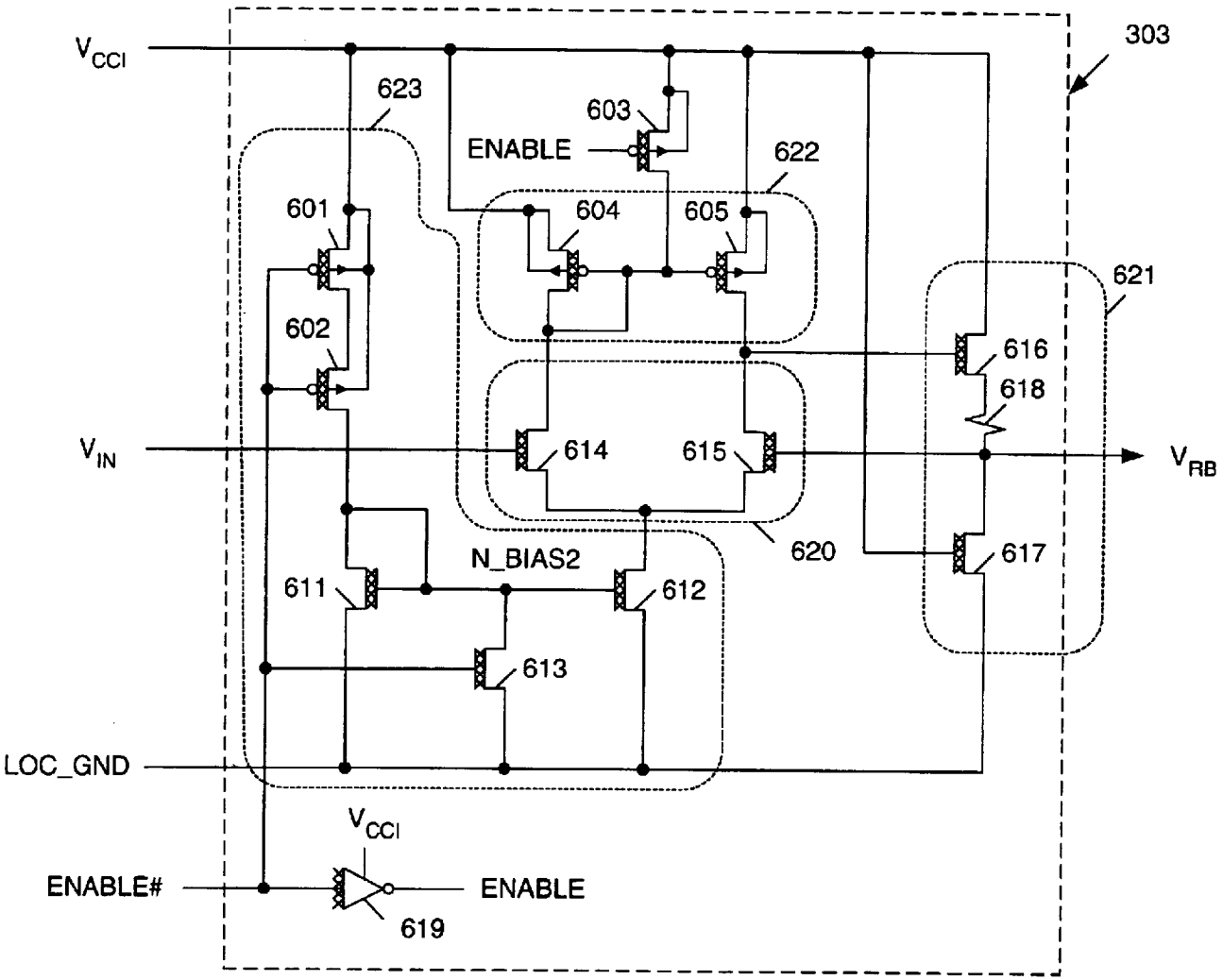
FIG. 6 is a circuit diagram illustrating output driver used in the read-back voltage generation circuit of FIG. 3 in accordance with one embodiment of the present invention.

FIG. 6 is a circuit diagram illustrating output driver 303 in accordance with one embodiment of the present invention. Output driver 303 is a low output impedance buffer that is capable of supplying the proper read-back voltage for the address lines on the chip. Output driver 303 includes thick-oxide p-channel transistors 601–605, thick-oxide n-channel transistors 611–617, resistor 618 and thick-oxide inverter 619. Thick-oxide elements are used in output driver 303, because these elements operate in response to the $V_{CCI}$ supply voltage, which is higher than the $V_{DD}$ supply voltage.

N-channel transistors 614 and 615 form a differential pair 620. The gate of n-channel transistor 614 is coupled to receive the voltage $V_{IN}$, which is equal to either 75% or 96% of the $V_{DD}$ supply voltage, as described above. The gate of n-channel transistor 615 is coupled to current limiting regulator output stage 621, which includes n-channel transistors 616 and 617. N-channel transistor 616 and resistor 618 are connected in series between the gate of transistor 615 and the $V_{CCI}$ voltage supply terminal. N-channel transistor 617 is coupled between the gate of transistor 615 and the ground supply terminal LOC_GND.

The differential pair 620 is supplied by a current mirror circuit 622 formed by p-channel transistors 604–605, and n-channel bias transistor 612. P-channel transistor 604 is coupled between the drain of n-channel transistor 614 and the $V_{CCI}$ supply voltage terminal, and p-channel transistor 605 is coupled between the drain of n-channel transistor 615 and the $V_{CCI}$ voltage supply terminal. The gates of p-channel transistors 604 and 605 are commonly coupled to the drain of n-channel transistor 614.

Current mirror circuit 622 is enabled and disabled by p-channel transistor 603, which is coupled between the $V_{CCI}$ voltage supply terminal and the gates of p-channel transistors 604 and 605. P-channel transistor 603 is controlled by an ENABLE signal provided by inverter 619. When the read-back voltage generation circuit 300 is enabled, the enable signal ENABLE# is activated low, thereby causing the ENABLE signal to go high. The high ENABLE signal turns off p-channel transistor 603, thereby enabling current mirror circuit 622.

The low ENABLE# signal also activates a bias control circuit 623, which includes p-channel transistors 601–602 and n-channel transistors 611–613. The logic low ENABLE# signal turns on p-channel transistors 601–602 and turns off n-channel transistor 613. As a result, a logic high bias voltage N_BIAS2 is developed on the gate of n-channel transistor 612, thereby causing a bias current to flow through this transistor 612, as well as differential pair 620. The gate of n-channel transistor 617 of output stage 621 is coupled to receive the $V_{CCI}$ supply voltage, thereby turning on this transistor 617.

Once enabled, output driver 303 operates in a manner similar to band-gap buffer 301. Thus, the enabled bias circuit 623 ensures that a constant current flows through bias transistor 612 (and thereby through differential pair 620). The enabled current mirror circuit 622 operates to maintain equal currents through differential pair transistors 614 and 615. The input voltage $V_{IN}$ causes a first current to flow through transistor 614 of differential pair 620. Current mirror 622 mirrors this current to transistor 615 of differential pair 620. The voltage on the drain of transistor 615 biases the gate of transistor 616 of output stage 621. In response, transistor 616 biases the read-back voltage $V_{RB}$ on the gate of transistor 615 to a voltage equal to the input voltage $V_{IN}$.

Resistor 618 limits the current in output stage 621, and reduces sharp transitions in a rising address voltage on an associated address line. Resistor 618 thereby reduces disturb conditions when reading back configuration data values from the configuration memory cells. During read-back mode, read-back voltage generation circuit 300 is enabled and the read-back voltage $V_{RB}$ is always on. However, whenever an address line is coupled to receive the read-back voltage $V_{RB}$, current is drawn from output stage 621, with resistor 618 limiting the amount of current that is drawn into the address line.

Figure 7:
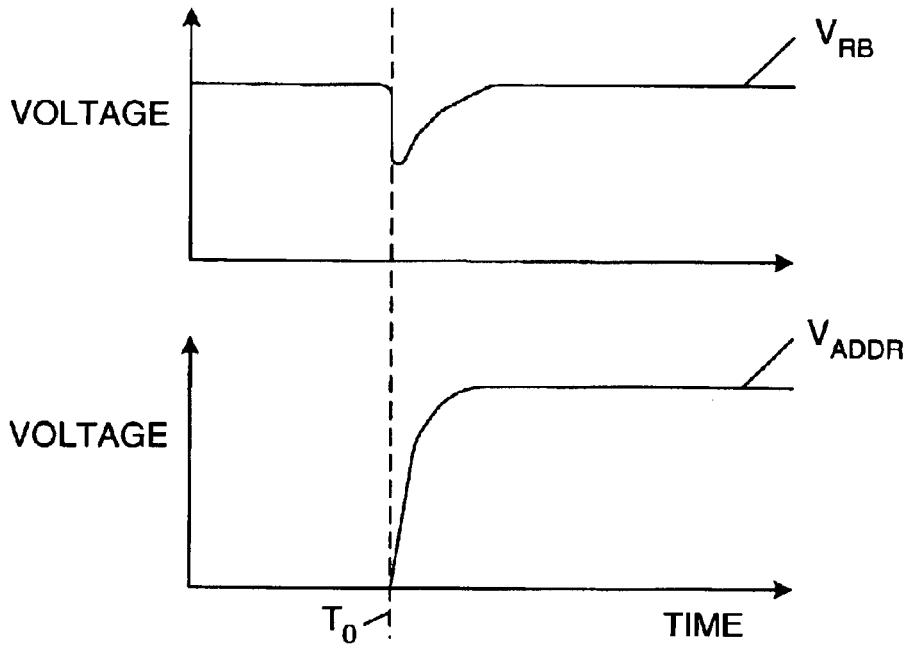
FIG. 7 is a graph illustrating a read-back voltage $V_{RB}$ and an associated address line voltage $V_{ADDR}$ in accordance with one embodiment of the present invention.

FIG. 7 illustrates the read-back voltage $V_{RB}$ and an address voltage $V_{ADDR}$ on an associated address line. The address line is coupled to receive the read-back voltage at time $T_0$. The gradual transition of the address voltage $V_{ADDR}$ helps to reduce disturb conditions in the configuration memory cells being read.

Figure 8:
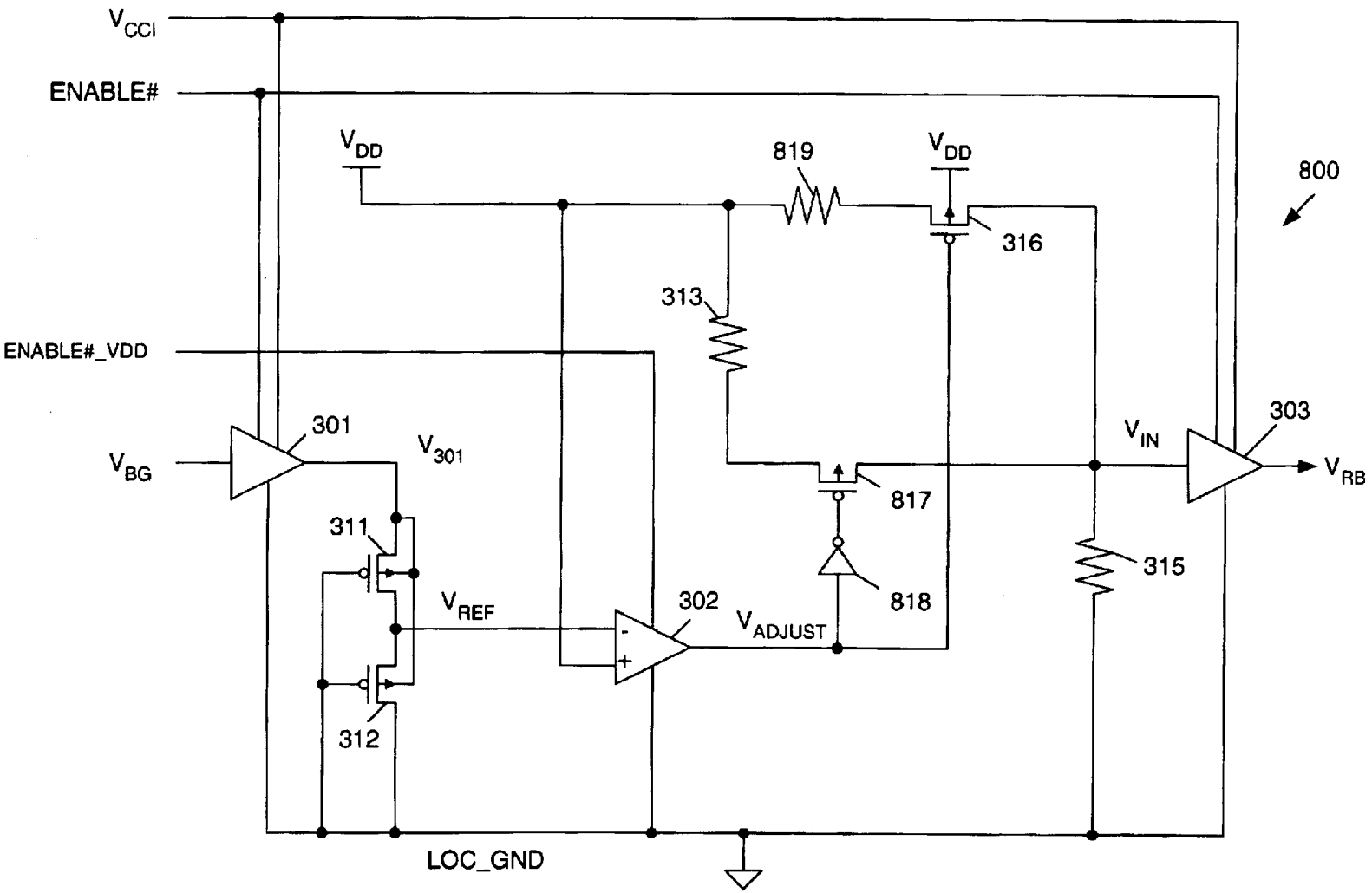
FIG. 8 is a circuit diagram of a read-back voltage generation circuit in accordance with one variation of the present invention.

FIG. 8 is a circuit diagram of a read-back voltage generation circuit 800 in accordance with one embodiment of the present invention. Because circuit 800 is similar to circuit 300 (FIG. 3), similar elements in FIGS. 3 and 8 are labeled with similar reference numbers. Thus, circuit 800 includes band-gap reference buffer 301, comparator 302, output driver 303, p-channel transistors 311–312, resistors 313 and 315 and p-channel pass transistor 316. In addition, circuit 800 includes p-channel pass transistor 817, inverter 818 and resistor 3-819. Resistor 819, which replaces resistor 314, has a value of about 4.3 kOhms (i.e., the equivalent parallel resistance of resistors 313 and 314). Circuit 800 operates in the same manner as circuit 300, with the following exceptions. When the $V_{ADJUST}$ voltage has a logic high value, pass transistor 817 is turned on and pass transistor 316 is turned off, thereby creating a voltage divider circuit that includes resistors 313 and 315. Conversely, when the $V_{ADJUST}$ voltage has a logic low value, pass transistor 817 is turned off and pass transistor 316 is turned on, thereby creating a voltage divider circuit that includes resistors 819 and 315.

Figure 9:
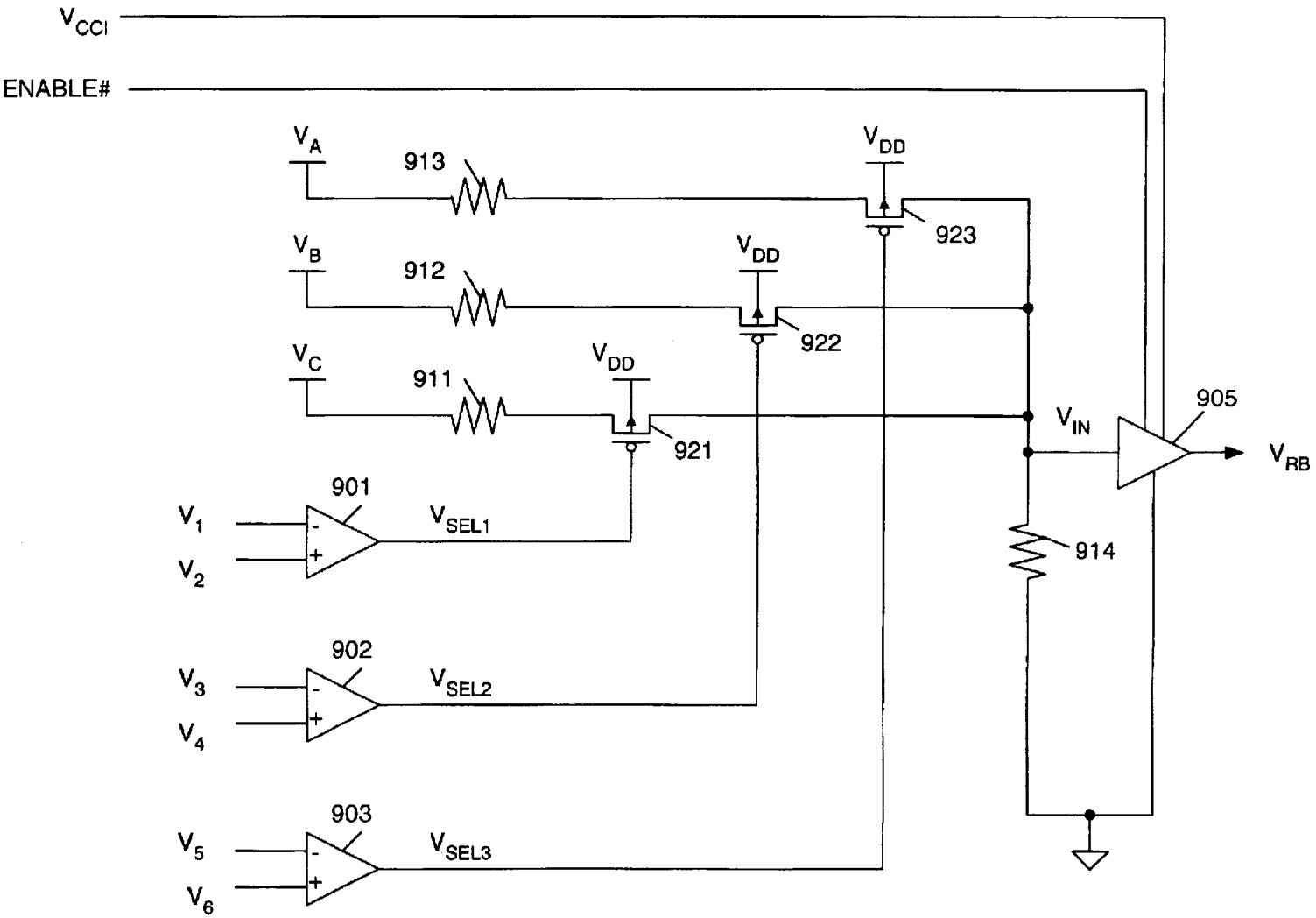
FIG. 9 is a circuit diagram of a read-back voltage generation circuit in accordance with yet another variation of the present invention.

FIG. 9 is a circuit diagram of a read-back voltage generation circuit 900 in accordance with yet another variation of the present invention. Circuit 900 includes comparators 901–903, output driver 905, resistors 911–914, and p-channel pass transistors 921–923. Comparators 901, 902 and 903 are configured to receive voltages $V_1$–$V_2$, $V_3$–$V_4$, and $V_5$–$V_6$, respectively. Comparator 901 provides a logic low voltage select signal $V_{SEL1}$ if $V_1$ is greater than $V_2$, and a logic high voltage select signal $V_{SEL1}$ if $V_1$ is less than $V_2$. Similarly, comparator 902 provides a logic low voltage select signal $V_{SEL2}$ if $V_3$ is greater than $V_4$, and a logic high voltage select signal $V_{SEL2}$ if $V_3$ is less than $V_4$. Comparator 903 provides a logic low voltage select signal $V_{SEL3}$ if $V_5$ is greater than $V_6$, and a logic high voltage select signal $V_{SEL3}$ if $V_5$ is less than $V_6$.

The voltage select signals $V_{SEL1}$, $V_{SEL2}$ and $V_{SEL3}$ are provided to the gates of p-channel pass transistors 921, 922 and 923, respectively. Resistors 911, 912 and 913 are connected between the voltage supply terminals $V_A$, $V_B$ and $V_C$ and pass transistors 921, 922 and 923, respectively. One end of resistor 914 is coupled to pass transistors 921–923 and the input terminal of output driver 905, and the other end of resistor 914 is coupled to the ground voltage supply terminal. In the described embodiment, voltages $V_A$, $V_B$ and $V_C$ are all equal to the $V_{DD}$ supply voltage, although this is not necessary. Voltage at terminals $V_A$, $V_B$ and $V_C$ can have different voltage levels in different embodiments.

Circuit 900 provides additional control over the read-back voltage $V_{RB}$ provided by output driver 905. For example, the $V_{DD}$ supply voltage can be provided to the plus input terminals of comparators 901–903 as the $V_2$, $V_4$ and $V_6$ signals. Different reference voltages can then be applied to the minus input terminals of comparators 901–903 as the $V_1$, $V_3$ and $V_5$ signals. In one example, voltage $V_1$ is selected to have a voltage of 1.35 Volts, such that the $V_{SEL1}$ voltage select has a logic low value if $V_{DD}$ is less than 1.35 Volts, and a logic high value otherwise. In this example, voltage $V_3$ is selected to have a voltage of 1.08 Volts, such that the $V_{SEL2}$ voltage select has a logic low value if $V_{DD}$ is less than 1.08 Volts, and a logic high value otherwise. Finally, voltage $V_5$ is selected is selected to have a voltage of 0.9 Volts, such that the $V_{SEL3}$ voltage select has a logic low value if $V_{DD}$ is less than 0.8 Volts, and a logic high value otherwise.

In this example, resistors 911–914 can have resistances of 33 kOhms, 33 kOhms, 6 kOhms and 100 kOhms, respectively. Thus, if the $V_{DD}$ supply voltage has a value less than 1.35 Volts, but greater than 1.08 Volts, then pass transistor 921 is turned on and pass transistors 922–923 are turned off. Under these conditions, the input voltage $V_{IN}$ to output driver 905 will have a value of about 75% of the $V_{DD}$ supply voltage.

If the $V_{DD}$ supply voltage has a value less than 1.08 Volts, but greater than 0.9 Volts, then pass transistors 921 and 922 are turned on and pass transistor 923 is turned off. Under these conditions, the input voltage $V_{IN}$ to output driver 905 will have a value of about 86% of the $V_{DD}$ supply voltage.

If the $V_{DD}$ supply voltage has a value less than 0.9 Volts, then pass transistors 921–923 are turned on. Under these conditions, the input voltage $V_{IN}$ to output driver 905 will have a value of about 96% of the $V_{DD}$ supply voltage.

In the foregoing manner, circuit 900 is able to provide more fine control over the value of the read-back voltage $V_{RB}$. Although circuit 900 uses three comparators 901–903, three pass transistors 921–923, and three resistors 911–913, it is understood that other numbers of comparators and pass transistors and resistors can be used in other embodiments. It is also understood that other voltages can be applied to comparators 901–903 in other embodiments.

Figure 10:
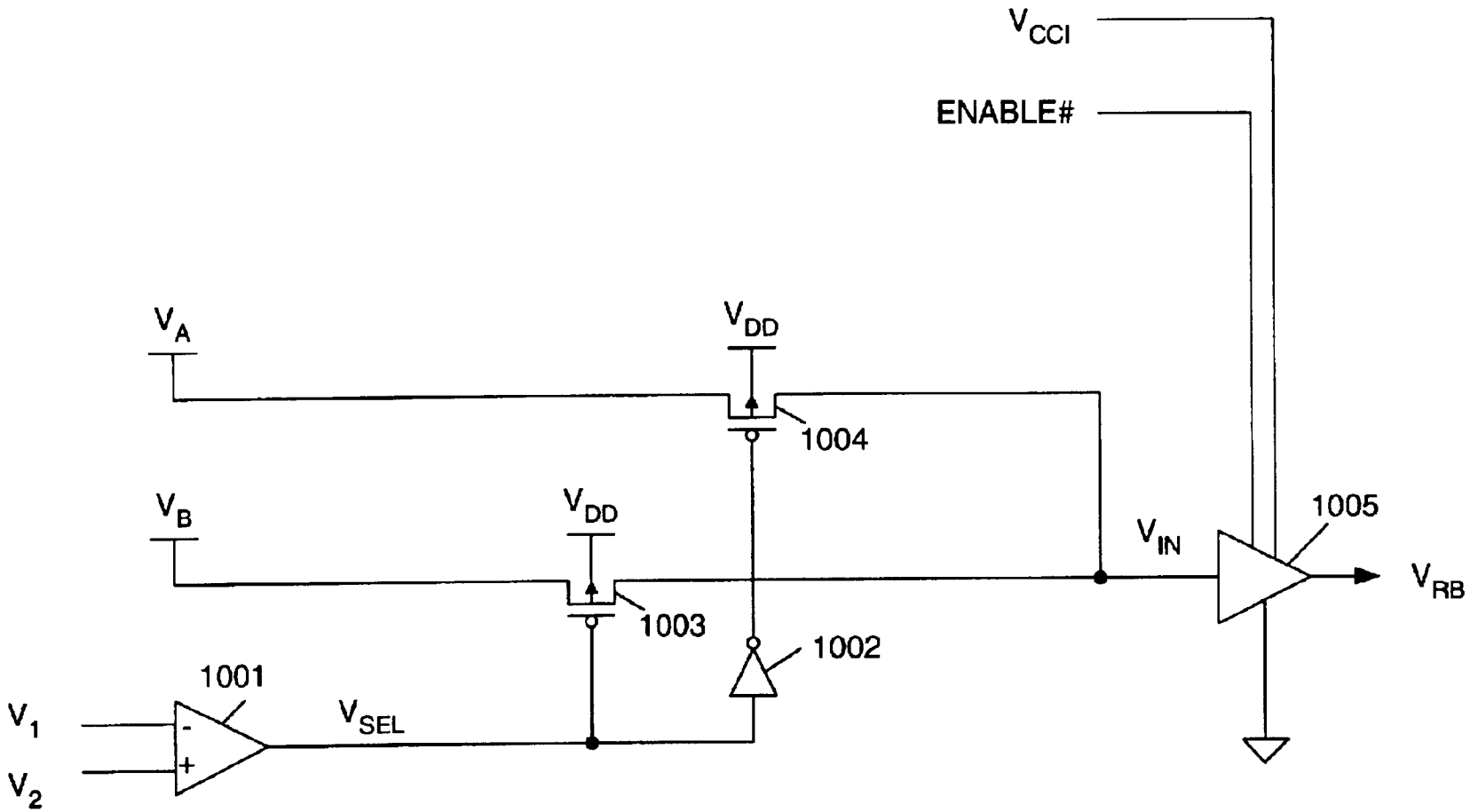
FIG. 10 is a circuit diagram of a read-back voltage generation circuit in accordance with yet another variation of the present invention.

FIG. 10 is a circuit diagram of a read-back voltage generation circuit 1000 in accordance with yet another variation of the present invention. Circuit 1000 includes comparator 1001, inverter 1002, p-channel pass transistors 1003–1004 and output driver 1005. Pass transistors 1003 and 1004 are configured to receive the voltages $V_B$ and $V_A$, respectively, wherein $V_B$ is greater than $V_A$. Comparator 1001 is configured to receive voltages $V_1$ and $V_2$. Comparator 1001 provides a logic low voltage select signal $V_{SEL}$ if $V_1$ is greater than $V_2$, and a logic high voltage select signal $V_{SEL}$ if $V_1$ is less than $V_2$.

If the $V_{SEL}$ signal has a logic low state, then p-channel transistor 1003 is turned on and transistor 1004 is turned off. As a result, the voltage $V_B$ is routed through pass transistor 1003 as the input voltage $V_{IN}$ to output driver 1005. Conversely, if the $V_{SEL1}$ signal has a logic high state, then p-channel transistor 1004 is turned on and p-channel transistor 1003 is turned off. As a result, the voltage $V_A$ is routed through pass transistor 1004 as the input voltage $V_{IN}$ to output driver 1005.

In one embodiment, the voltage $V_2$ is equal to the $V_{DD}$ supply voltage, and the voltage $V_1$ is equal to the reference voltage $V_{REF}$. In this embodiment, the voltage $V_A$ is less than the reference voltage $V_{REF}$. Alternatively, in this embodiment, the voltage $V_A$ can be equal to the reference voltage $V_{REF}$, and the voltage $V_B$ can be equal to the $V_{DD}$ supply voltage. As a result, when the $V_{DD}$ supply voltage is greater than the reference voltage $V_{REF}$, then the reference voltage $V_{REF}$ is routed as the input voltage $V_{IN}$. Conversely, when the $V_{DD}$ supply voltage is less than the reference voltage $V_{REF}$, then the $V_{DD}$ supply voltage is routed as the input voltage $V_{IN}$. Note that the configuration of FIG. 10 can be substituted in the circuits of FIGS. 3, 8 and 9 in accordance with other embodiments of the present invention.

Although the invention has been described in connection with several embodiments, it is understood that this invention is not limited to the embodiments disclosed, but is capable of various modifications, which would be apparent to one of ordinary skill in the art. Thus, the read-back voltage generation circuit of the present invention can be used in a variety of integrated circuit devices, including, but not limited to, field programmable gate arrays. Thus, the invention is limited only by the following claims.

I claim:

1. A voltage generation circuit comprising:

a comparator configured to receive and a supply voltage and a reference voltage and to perform a comparison therebetweeen, and in response, activate a select signal if the supply voltage has a predetermined relationship with respect to the reference voltage, and de-activate the select signal if the supply voltage does not exhibit the predetermined relationship with respect to the reference voltage; and an adjustable voltage divider circuit coupled to receive the supply voltage and the select signal, wherein the adjustable voltage divider circuit is configured in response to the select signal to provide an output voltage that is a first percentage of the supply voltage if the select signal is activated, and provide an output voltage that is a second percentage of the supply voltage if the select signal is de-activated.

2. The voltage generation circuit of claim 1, further comprising an output driver configured to receive the output voltage.

3. The voltage generation circuit of claim 2, further comprising an address line coupled to an output terminal of the output driver, wherein the output driver provides the output voltage as a read-back voltage on the address line.

4. The voltage generation circuit of claim 1, wherein the output driver further comprises a current limiting output stage configured to soften a rising edge of the output voltage.

5. The voltage generation circuit of claim 4, wherein the current limiting output stage comprises a resistor coupled between an output terminal of the output driver and a terminal that provides the supply voltage.

6. The voltage generation circuit of claim 1, further comprising a bandgap voltage generator configured to generate a bandgap voltage, wherein the reference voltage is derived from the bandgap voltage.

7. The voltage generation circuit of claim 6, further comprising a voltage divider circuit coupled to the bandgap voltage generator, wherein the voltage divider circuit provides the reference voltage in response to the bandgap voltage.

8. The voltage generation circuit of claim 1, wherein the predetermined relationship is defined by the supply voltage being less than the reference voltage.

9. The voltage generation circuit of claim 8, wherein the first percentage is greater than the second percentage.

10. The voltage generation circuit of claim 9, wherein the first percentage is about 95 to 100 percent, and the second percentage is less than 95 percent.

11. The voltage generation circuit of claim 1, wherein the adjustable voltage divider circuit comprises:

a first resistor and a pass transistor coupled in series between a supply voltage terminal coupled to receive the supply voltage and an output terminal configured to provide the output voltage, the pass transistor having a gate coupled to receive the select signal; and a second resistor coupled between the output terminal and a second voltage supply terminal coupled to receive a second supply voltage, wherein the output voltage is provided on the output terminal.

12. The voltage generation circuit of claim 11, wherein the adjustable voltage divider circuit further comprises a third resistor coupled between the supply voltage terminal and the output terminal.

13. The voltage generation circuit of claim 11, wherein the adjustable voltage divider circuit further comprises a third resistor and a second pass transistor coupled in series between the supply voltage terminal and the output terminal, the second pass transistor having a gate coupled to receive the inverse of the select signal.

14. The voltage generation circuit of claim 1, further comprising:

a second comparator configured to receive the supply voltage and a second reference voltage, and in response, activate a second select signal if the supply voltage has a predetermined relationship with respect to the second reference voltage, and de-activate the second select signal if the supply voltage does not exhibit the predetermined relationship with respect to the second reference voltage;

wherein the adjustable voltage divider circuit is configured in response to the first and second select signals to provide an output voltage that is a first percentage of the supply voltage if the select signal is activated and the second select signal is de-activated, and provide an output voltage that is a second percentage of the supply voltage if the select signal and the second select signal are both activated.

15. A method of generating an output voltage in response to a supply voltage and a reference voltage, the method comprising:

comparing the supply voltage with the reference voltage;

activating a select signal if the supply voltage is less than the reference voltage;

de-activating the select signal if the supply voltage is greater than the reference voltage;

providing an output voltage that is a first percentage of the supply voltage if the select signal is activated; and providing an output voltage that is a second percentage of the supply voltage if the select signal is de-activated, wherein the first percentage is greater than the second percentage.

16. The method of claim 15, further comprising driving the output voltage as a read-back voltage onto an address line.

17. The method of claim 15, further comprising deriving the reference voltage from a bandgap voltage generator.

18. The method of claim 15, wherein the first percentage is about 95 to 100 percent, and the second percentage is less than 95 percent.

19. The method of claim 15, further comprising enabling a first leg of a voltage divider circuit when the select signal is activated.

20. The method of claim 19, further comprising enabling a second leg of a voltage divider circuit when the select signal is de-activated.

21. The method of claim 15, further comprising comparing the supply voltage with a second reference voltage, wherein the first reference voltage is greater than the second reference voltage;

activating a second select signal if the supply voltage is less than the second reference voltage;

de-activating the second select signal if the supply voltage is greater than the second reference voltage;

providing an output voltage that is the first percentage of the supply voltage if the select signal is activated and the second select signal is de-activated;

providing an output voltage that is the second percentage of the supply voltage if the select signal and the second select signal are de-activated; and providing an output voltage that is a third percentage of the supply voltage if the select signal and the second select signal are activated, wherein the third percentage is greater than the first percentage.

22. A voltage generation circuit for generating an output voltage, the voltage generation circuit comprising:

a first comparator configured to receive a first supply voltage and a first reference voltage, and in response, activate a first select signal if the first supply voltage has a first predetermined relationship with respect to the first reference voltage, and de-activate the first select signal if the first supply voltage does not exhibit the first predetermined relationship with respect to the first reference voltage;

a second comparator configured to receive a second supply voltage and a second reference voltage and in response, activate a second select signal if the second supply voltage has a second predetermined relationship with respect to the second reference voltage, and de-activate the second select signal if the second supply voltage does not exhibit the second predetermined relationship with respect to the second reference voltage; and an adjustable voltage divider circuit coupled to receive the first select signal and the second select signal, wherein the adjustable voltage divider circuit is configured to provide an output voltage that is a first percentage of a fifth voltage if the first select signal is activated, and provide an output voltage that is a second percentage of a sixth voltage if the second select signal is activated.

* * * * *